United States Patent [19]

Filice et al.

[11] Patent Number: 4,819,608

[45] Date of Patent: Apr. 11, 1989

[54] ARCHERY BOW LIMB CONSTRUCTED OF SYNTACTIC FOAM

[75] Inventors: Gary W. Filice, Moorpark, Calif.; Earl H. Hoyt, Jr., Bridgeton, Mo.

[73] Assignee: Hoyt/Easton Archery Co., Salt Lake City, Utah

[21] Appl. No.: 89,039

[22] Filed: Aug. 24, 1987

[51] Int. Cl.[4] ..... F41B 5/00

[52] U.S. Cl. ..... 124/23 R

[58] Field of Search ..... 124/23 R, 24 R, 24

[56] References Cited

U.S. PATENT DOCUMENTS

| | | | |
|---|---|---|---|
| 3,015,327 | 1/1962 | Lightcap | 124/23 R |
| 3,147,975 | 5/1960 | Gruss et al. | 273/82 R |
| 3,229,978 | 1/1966 | Guglielmo | 273/82 R |
| 3,537,440 | 11/1970 | Izuta | 124/88 |
| 3,659,577 | 5/1972 | Richardson et al. | 124/24 R |
| 3,690,658 | 9/1972 | Howe | 273/DIG. 7 |
| 4,013,810 | 3/1977 | Long | 273/DIG. 23 |
| 4,207,859 | 6/1980 | Scholten | 124/24 R |

FOREIGN PATENT DOCUMENTS

| | | | |
|---|---|---|---|
| 811473 | 4/1969 | Canada | 124/23 R |

OTHER PUBLICATIONS

3M Brochure, "3M" Glass Bubbles . . . Engineered Fillers, undated.

Robert H. Wehrenberg II, Assistant Editor, "Shedding Pounds in Plastics: Microspheres are Moving", 1978, Pneton/IPC. Inc., pp. 0–5.

MIL-S-24154A Amendment-1 dated Mar. 28, 1967, p. 1.

MIL-S-24154A dated Mar. 10, 1967, pp. 1–17.

George E. Melber, Kathleen M. Gibbons and Thomas F. Anderson, "Organic Microspheres for Supertough Syntactic Foams", Jan. 16–19, 1984, Section 12-D, pp. 1–6.

*Primary Examiner*—Richard C. Pinkham

*Assistant Examiner*—Gary Jackson

*Attorney, Agent, or Firm*—Mallinckrodt & Mallinckrodt

[57] ABSTRACT

A laminated archery bow limb has a relatively light weight core consisting of a plurality of hollow micro spheres in a matrix of hard synthetic resin and formed as a tapered strip of "syntactic foam" material with relatively thin facing and backing strips of high tensile and compressive strengths and a high rate of recovery glued to opposite sides thereof. In a second form of bow limb construction the core material further includes, in addition to the hollow micro spheres, reinforcing fibres to increase the physical strength thereof.

18 Claims, 1 Drawing Sheet

10
14
16
12

18
22
20

24

24

24

28
26
10 or 12

28
26
24

12
12

28
26
18 or 20

28
24
26

12
12
18 or 20

24
28
SYNTACTIC FOAM
26

ARCHERY BOW LIMB CONSTRUCTED OF SYNTACTIC FOAM

BACKGROUND OF THE INVENTION

This invention relates to archery bow limb construction and particularly to laminated bow limbs having a core strip to which tensile and compressive strips are glued to opposite sides thereof.

It has been the practice for a long time to face and back archery bow limbs with strips of material having higher tensile and compressive strengths than the material of which the limbs were ordinarily constructed, usually wood of some kind. More recently, laminated bow limb construction has often considered in gluing a strip of composite material usually composed of glass, graphite or other suitable fibres in a matrix of hard sythetic resin to the back and face of a solid or laminated hard wood core strip.

It has been found that a substantial reduction in bow limb inertia resulting in a substantial increase in arrow velocity is achieved by reducing the weight of the core strip. Applicants have substantially reduced the weight of the core strip while retaining adequate physical properties for the purpose by constructing the core of a material known as "syntactic foam" which consists of a plurality of hollow micro spheres of less than 100 microns in diameter in a matrix of hard synthetic resin. The relative volume of hollow spheres is such as to attain a density of the "syntactic material" which is substantially less than any solid or composite hardwood core.

It was also found that in addition to reducing the weight of the core strip and therefore the inertia of the bow limb in this manner, that the hollow micro spheres in the core material also function as microscopic shock absorbers to dissipate energy of impact and therefore the syntactic material has a relatively high resistance to impact which renders the material peculiarly suitable to bow limb construction. Archery bow limbs in normal usage are subjected to relatively high impact stress every time an arrow is shot and the bow limbs approach a braced position.

In the case of heavier hunting bows it is contemplated employing, in addition to the hollow micro spheres, reinforcing fibres for further enhancing the physical properties of the syntactic material while maintaining a density substantially below that of any solid or laminated hardwood. Moreover, when molding the cores the rolling action of the spheres helps distribute evenly the hollow micro spheres and fibres in the very thin tip ends of the tapered cores.

OBJECTS OF THE INVENTION

The primary object of this invention is to provide a generally new and improved construction of the limbs for an archery bow.

It is a further object to provide a laminated bow limb which is of light weight yet possessed of adequate physical properties for the purpose.

It is a further object to provide a laminated bow limb which is light in weight and has relatively high impact strength.

More specifically, it is a further object to provide a laminated, light weight bow limb core material which includes hollow micro spheres in a matrix of hard synthetic resin.

It is a further object to provide a laminated bow limb core material which includes hollow micro spheres and reinforcing fibres.

These and other objects and advantages will become apparent when reading the following description in connection with the accompanying drawings.

IN THE DRAWINGS

Figures 1, 2, 3, 4, 5, 6, 7, 8, 9, 10, 11, 12:
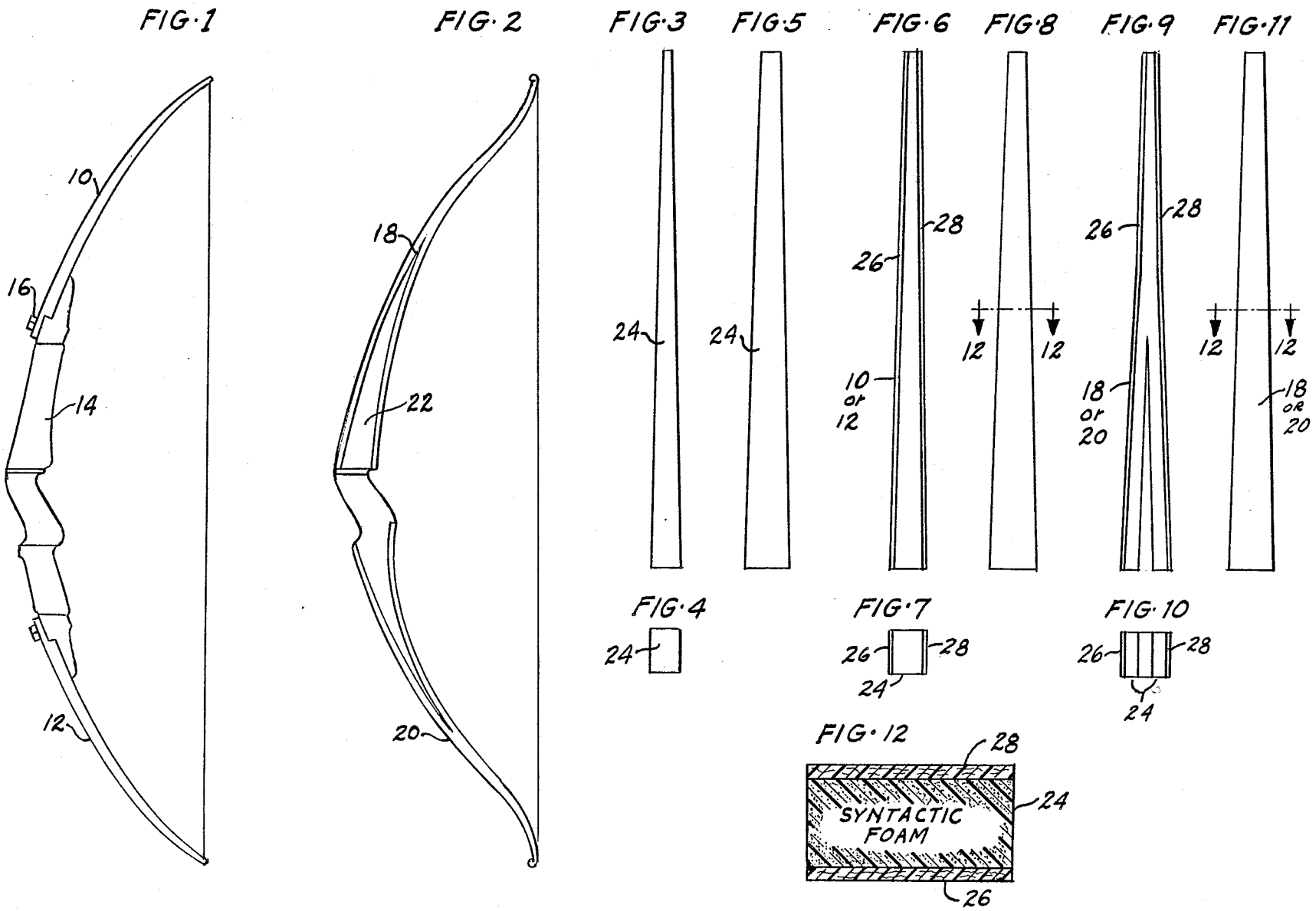
FIG. 1 is a side elevational view of a take-down bow having an upper and a lower laminated bow limb which are constructed in accordance with the present invention and detachably connected to an intermediate handle section.
FIG. 2 is a side elevational view of a conventional long bow having upper and lower laminated bow limbs constructed in accordance with the present invention, the limbs being split at their butt ends and permanently connected to the upper and lower end portions of an intermediate handle section as by gluing.
FIGS. 3 and 4 are edge and butt end elevational views of the bow limb core.
FIG. 5 is a side elevational view of the limb core shown in FIGS. 3 and 4.

FIGS. 6 and 7 are edge and butt end elevational views of the bow limbs 10 and 12 of the take-down bow shown in FIG. 1;

FIG. 8 is a side elevational view of the bow limb shown in FIGS. 6 and 7;

FIGS. 9 and 10 are edge and butt end elevational views of a split bow limb for the conventional long bow shown in FIG. 2;

FIG. 11 is a side elevational view of the limb shown in FIGS. 9 and 10; and FIG. 12 is an enlarged cross sectional view taken on lines 12—12 of FIGS. 8 and 11.

DESCRIPTION OF A PREFERRED FORM OF THE INVENTION

A take-down bow is shown in FIG. 1 in which the upper and lower tapered bow limbs 10 and 12 are detachably connected to an intermediate handle section 14 by cap screws 16. The tapered bow limbs 10 and 12 may be adjustably mounted on the intermediate handle section 10 so as to be adjustable fore and aft if desired. FIG. 2 shows a conventional long bow in which the tapered limbs 18 and 20 are split longitudinally at their butt end portions and extend over opposite end portions of the intermediate handle section 22 and are permanently attached thereto as by gluing. It will be understood that the bow limb core materials and facing and backing strips may be the same for the take-down bow of FIG. 1 and the conventional long bow shown in FIG. 2. The facing or tension and backing or compression strips are at 26 and 28, respectively, FIGS. 6 and 9.

The tapered bow limb core 24 shown in FIGS. 3 to 5 is molded of a material known as "syntactic foam" which consists of a plurality of hollow micro spheres in a matrix of hard synthetic resin. The micro spheres are less than 100 microns in diameter and the volume proportion of the hollow micro spheres to the synthetic resin matrix are such that the density of the "syntactic foam" is substantially less than a solid or laminated hard wood core, such as hard rock maple.

In a tapered laminated bow limb consisting of a tapered core sandwiched between relatively thin tension and compression strips a substantial decrease in the density of the core would logically be followed by a substantial decrease in the inertia of the bow limb and a substantial increase in the velocity of the bow limb, provided the rate of the restoring force of the composite limb is equivalent. While the restoring force of the strip of "syntactic foam" material forming the core may be slightly less than that of any core material heretofore used, the lightness of the "syntactic foam" core material used plus it's greater compressional strength acting to maintain dimensional separation between the tension and compression strips glued thereto result in the provision of a composite bow limb having greater recovery speed when released from a stressed and deformed position.

The laminated bow limbs when connected to a handle section and released from a drawn bow position accelerate toward a braced position where they are suddenly stopped by the taut bow string thereby receiving, in normal operation, a great impact stress. In the syntactic foam material, of which the bow limb cores are formed, the hollow micro spheres act as miniature shock absorbers to asborb energy and impact and therefore perform yet another function which is particularly advantageous in the present use of the material. Another somewhat less important function and advantage of the hollow micro spheres in the syntactic foam is to assist in the even distribution of the spheres due to their tendency to roll on each other when molding the limb cores all of which are tapered and some of which have extremely thin and feathered end portions.

When usage requires a bow limb core of unusual physical strength, glass, graphite or other suitable reinforcing fibres may be added to the bow limb core material in addition to the hollow micro spheres while maintaining the density of the core material.

The intermediate handle sections 14 and 22 of the take-down and conventional long bows shown in FIGS. 1 and 2 may be constructed of any suitable material such as wood or metal having sufficient rigidity for the purpose. The attachment of the upper and lower bow limbs to the handle sections may be by cap screws, as shown, in the take-down bow of FIG. 1 and by splitting the cores of the limbs longitudinally inward from the butt ends and in gluing them perminently to the handle section as shown in the conventional long bow of FIG. 1.

The foregoing description is intended to be illustrative and not limiting, the scope of the invention being set forth in the appended claims.

We claim:

1. An archery bow, comprising a handle section; a pair of bow limbs attached to and extending outwardly from the handle section to provide a pair of spaced limb tips, each limb having a side adapted to face the archer and a side adapted to face away from the archer when the bow is in use, and each limb including a core of a syntactic foam material, a strip of tension material intimately secured along its length to the core along the side of the limb adapted to face away from the archer, and a strip of compression material intimately secured along its length to the core along the side of the limb adapted to face the archer; a bowstring; and means coupling the bowstring to the limb tips.

2. An archery bow according to claim 1, wherein the syntactic foam comprises a plurality of hollow spheres in a matrix of hard synthetic resin and the diameter of such hollow spheres does not exceed about 100 microns.

3. An archery bow according to claim 2, wherein the diameter of the hollow spheres average about 60 microns.

4. An archery bow according to claim 2, wherein the density of the syntactic foam is less than the density of a comparable hard wood core.

5. An archery bow according to claim 4, additionally including reinforcing fibers in the syntactic foam.

6. An archery bow according to claim 4, wherein the tension and compression strips include a matrix of hard synthetic resin and strengthening glass fibers embedded therein.

7. An archery bow according to claim 4, wherein the tension and compression strips include a matrix of hard synthetic resin and strengthening graphite fibers therein.

8. An archery bow according to claim 4, wherein the tension and compression strips include a matrix of hard synthetic resin and strengthening glass and graphite fibers therein.

9. An archery bow according to claim 4, wherein the tension strip includes a matrix of hard synthetic resin and strengthening glass and graphite fibers therein.

10. A pair of composite bow limbs in an archery bow, each limb fixed at one end to an intermediate handle section and each comprising a core strip of syntactic foam, said syntactic foam comprising a plurality of hollow spheres in a matrix of hard synthetic resin; tension strips intimately secured along their lengths to corresponding sides, respectively, of one set of sides of said core strips, compression strips intimately secured along their lengths to opposite corresponding sides, respectively, of said core strips, said tension and compression strips each comprising a matrix of hard synthetic resin and strengthening fibers embedded in said resin.

11. A pair of composite bow limbs according to claim 10, wherein the hollow spheres included in the syntactic core strips do not exceed about 100 microns in diameter.

12. A pair of composite bow limbs according to claim 11, wherein the diameter of the hollow spheres average about 60 microns.

13. A pair of composite bow limbs according to claim 11, wherein the density of the syntactic foam is less than the density of a comparable hard wood core.

14. A pair of composite bow limbs according to claim 13, additionally including reinforcing fibers in the syntactic foam.

15. A pair of composite bow limbs according to claim 13, wherein the strengthening fibers embedded in the tension and compression strips are glass fibers.

16. A pair of composite bow limbs according to claim 13, wherein the strengthening fibers embedded in the tension and compression strips are graphite fibers.

17. A pair of composite bow limbs according to claim 13, wherein the strengthening fibers embedded in the tension and compression strips are a combination of glass and graphite fibers.

18. A pair of composite bow limbs according to claim 13, wherein the strengthening fibers embedded in the tension strips are a combination of glass and graphite fibers.

* * * * *